US007344016B2

(12) United States Patent
Vogel et al.

(10) Patent No.: US 7,344,016 B2
(45) Date of Patent: Mar. 18, 2008

(54) METHOD AND DEVICE FOR ORIENTING FLAT ITEMS OF MAIL TOWARDS A NARROW EDGE

(75) Inventors: Rainer Vogel, Constance (DE); Michael Schwarzbauer, Constance (DE)

(73) Assignee: Siemens AG, München (DE)

( * ) Notice: Subject to any disclaimer, the term of this patent is extended or adjusted under 35 U.S.C. 154(b) by 150 days.

(21) Appl. No.: 10/554,412

(22) PCT Filed: Mar. 25, 2004

(86) PCT No.: PCT/EP2004/003147

§ 371 (c)(1),
(2), (4) Date: Oct. 24, 2005

(87) PCT Pub. No.: WO2004/096454

PCT Pub. Date: Nov. 11, 2004

(65) Prior Publication Data

US 2006/0249438 A1 Nov. 9, 2006

(30) Foreign Application Priority Data

May 2, 2003 (DE) ..... 103 19 723

(51) Int. Cl.
*B07C 1/06* (2006.01)

(52) U.S. Cl. ..... 198/412; 198/502.2; 198/819; 198/406; 271/253; 271/254; 271/262; 271/263; 271/3.12

(58) Field of Classification Search ..... 271/2, 271/3.12, 226, 240, 253, 254, 262, 263; 198/412, 198/502.2, 819
See application file for complete search history.

(56) References Cited

U.S. PATENT DOCUMENTS 3,203,534 A 8/1965 Burkhardt et al.
4,973,039 A * 11/1990 Jeske et al. ..... 271/151
4,995,504 A 2/1991 Kuehn (Continued)

FOREIGN PATENT DOCUMENTS

DE 12 17 878 B 5/1966

(Continued)

OTHER PUBLICATIONS

Abstract—DE-12 17 878 B; May 26, 1966; Standard Elektrik Lorenz Aktiengesellschaft, Stuttgart-Zuffhausen, Germany.
Derwent Abstract—DE-195 28 829 C2; Feb. 6, 1997; Siemens AG, D-80333 München, Germany.
Derwent Abstract—FR-2 692 565 A1 ; Dec. 24, 1993 ; Compagnie Generale d'Automatisme CGA-HBS Société Anonyme, France.

*Primary Examiner*—Douglas A Hess

(57) ABSTRACT

A method and device are disclosed for orienting flat items of mail towards a narrow edge in a U-shaped conveying channel in which they are conveyed in an upright position and without being jammed. Before the items pass the conveying channel for the purpose of alignment, their thickness is measured. The distances of the lateral limit stops or limiting sections are changed by means of adjusting mechanisms for every item of mail in such a manner that at the end of the conveying channel, the item is oriented towards its lower narrow edge by virtue of its own gravity and the distance of the lateral limit stops of the conveying channel from every item of mail during transport through the conveying channel is only wide enough for the item not to collapse at all nor to collapse partially even if its intrinsic stiffness is poor.

6 Claims, 2 Drawing Sheets

U.S. PATENT DOCUMENTS 5,331,151 A * 7/1994 Cochran et al. ..... 250/223 R
5,465,825 A * 11/1995 Levaro et al. ..... 198/444
5,507,479 A * 4/1996 Martin et al. ..... 271/11
5,560,598 A * 10/1996 Goldkuhle ..... 271/263
6,196,537 B1 * 3/2001 Conner et al. ..... 270/52.15
6,328,300 B1 * 12/2001 Stefan et al. ..... 271/2
6,435,498 B1 * 8/2002 Stefan et al. ..... 271/2
6,536,756 B2 * 3/2003 Stefan et al. ..... 271/2
6,746,009 B2 * 6/2004 Engarto et al. ..... 271/2
6,877,739 B2 * 4/2005 Leitz et al. ..... 271/178
7,052,008 B2 * 5/2006 Mitsuya et al. ..... 271/122
7,096,743 B2 * 8/2006 Vogel et al. ..... 73/849

FOREIGN PATENT DOCUMENTS

DE 195 28 829 C2 2/1997
FR 2 692 565 A1 12/1993

* cited by examiner

METHOD AND DEVICE FOR ORIENTING FLAT ITEMS OF MAIL TOWARDS A NARROW EDGE

BACKGROUND OF THE INVENTION

The invention relates to a method and a device for orienting flat items of mail towards a narrow edge.

Stacks of items of mail are automatically separated at the input end of the sorting machine for items of mail, with the respective frontmost item of mail being removed in each instance. The individual items of mail are then conveyed one after the other in an upright position to processing devices such as address readers and printers. This prevents the items of mail at the processing devices from being rotated or elevated. Since this is frequently the case after separation, the items of mail pass through an orientation path after separation. (cf. DE 1 116 602 A, DE 37 09 659 C2, DE 195 28 829 C2, FR 2 692 565 A1). In DE 1 116 602 A, DE 37 09 659 C2, DE 195 28 829 C2 and FR 2 692 565 A1, these consist of an open U-shaped conveying channel, in which the items of mail are conveyed in an upright position without any lateral pressure. In this case, the items of mail are oriented towards the lower narrow edge (lower edge) whilst passing through the orientation path by virtue of their own gravity. The orientation path is thereby designed for 'acceptable' ranges in relation to thicknesses, i.e. either for letters and cards or large letters, magazines etc. If, however, a broad thickness range is to be processed, i.e. both thin letters and magazines, the distance of the lateral limit stops of the transport channel must be designed for the maximum thickness of an item of mail.

Thin items of mail with poor intrinsic stiffness however can collapse at least partially whilst passing through the essentially wider conveying channel. They are not then correctly oriented when transferred on the subsequent transport path to the processing devices, this possibly resulting in transport faults, damage to items of mail and reading errors.

SUMMARY OF THE INVENTION

The object underlying the invention is thus to create a method and a device for orienting flat items of mail towards a narrow edge with a U-shaped conveying channel, in which the items of mail are conveyed standing on a narrow edge in an upright position without being jammed, both thick and thin items of mail with poor intrinsic stiffness being able to be oriented without the thin soft items of mail collapsing.

According to one aspect, the thickness of the items of mail is measured before they pass through the conveying channel for orientation purposes. The distances of the lateral limit stops or limiting sections are changed by means of adjusting mechanisms for every mail item in such a manner that the item of mail at the end of the conveying channel is oriented towards its lower narrow edge by virtue of its own gravity and the distance of the lateral limit stops of the conveying channel from every item of mail during transport through the conveying channel is just wide enough for the item not to collapse at all nor to collapse partially even if its intrinsic stiffness is poor.

Advantageous embodiments of the invention are illustrated in the subclaims.

If a number of items of mail pass through the conveying channel at the same time, it is advantageous to design the lateral limit stops to be flexible. From the known transport speed and a detected front and/or back edge, the length and position of each item of mail during its transport through the conveying channel is determined as a function of the time, and with this data, the flexible lateral limit stops across the length of the conveying channel are changed in terms of their distance to each other for each item of mail, such that the lateral limiting sections adjusted to the respective thicknesses and lengths of the items of mail, move like standing waves in conjunction with the items of mail.

It is also advantageous to provide lateral transport belts which circulate at the same speed as the underframe belt, and are guided via rollers as flexible and gentle lateral limit stops of the conveying channel.

In a further advantageous variant of the embodiment, driven rollers are provided as lateral limit stops of the conveying channel, between which are attached guide plates fixed to the roller supports, the peripheral speed of these rollers corresponding to the transport speed of the underframe belt.

If the distances between the items of mail are so large that there is only ever one item of mail in the conveying channel, it is sufficient for the adjusting mechanism to adjust all rollers collectively by the same amount respectively, the adjusting mechanism being able to be realized in a very cost-effective manner.

BRIEF DESCRIPTION OF THE SEVERAL VIEWS OF THE DRAWINGS

The invention is described in more detail below in an exemplary embodiment with reference to the drawing, in which.

DETAILED DESCRIPTION OF THE INVENTION

Figure 1:
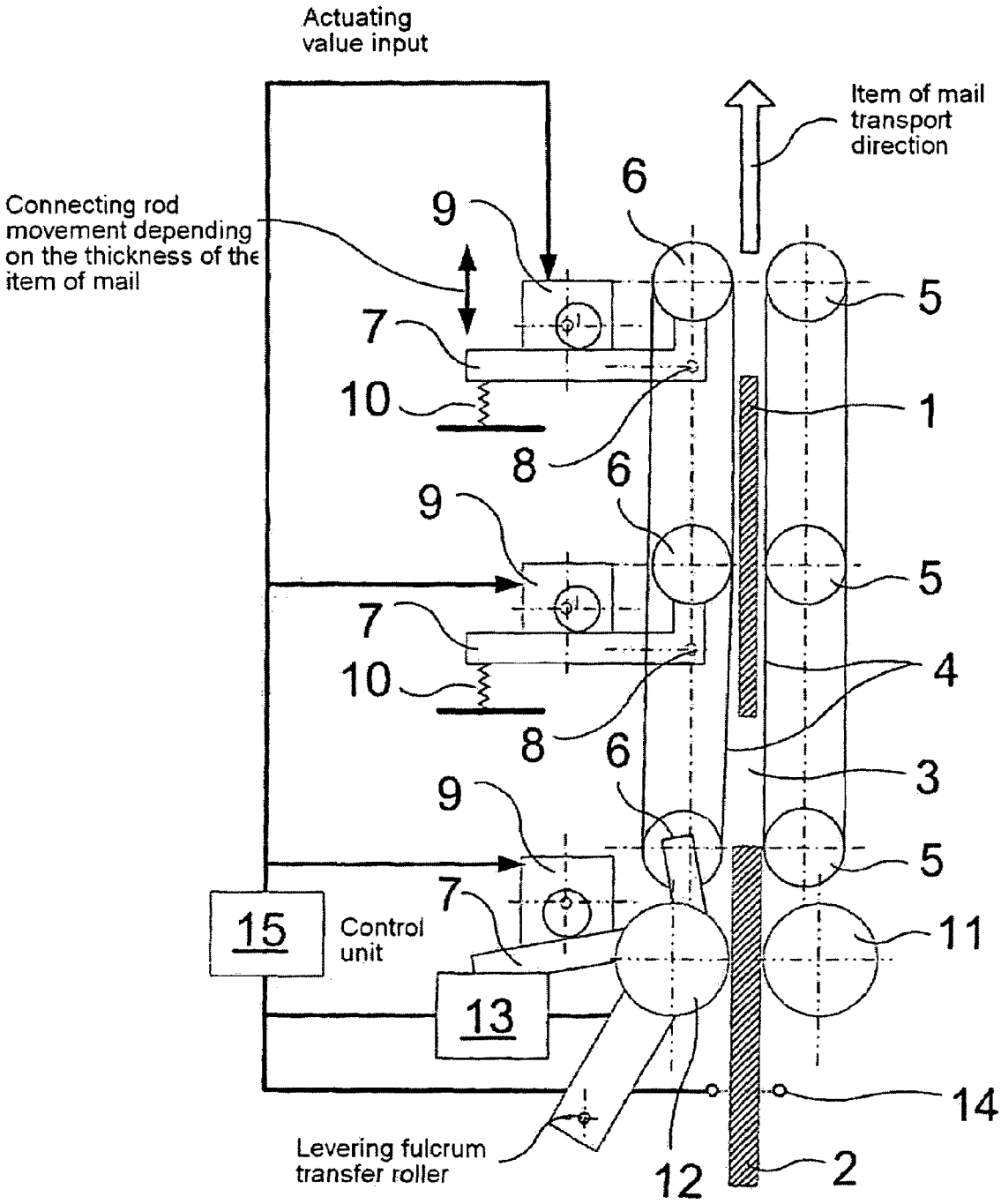
FIG. 1 shows a schematic overhead view on a generic device with lateral transport belts guided over rollers, with the position of the rollers being separately adjustable on one edge.

As illustrated in FIG. 1, a conveyed item of mail 2 is fed to a conveying channel 3 for orientation purposes by means of transfer rollers 11, 12, of which at least one is driven and one is supported locally so that it can move, and is pushed by means of a spring element (not shown) in the direction of the other transfer roller with a lower tension, the driven underframe belt of said conveying channel not being shown to aid clarity. In this case, the moveable supported transfer roller 12 is pushed outwards by the item of mail 2. This movement is evaluated by a thickness sensor 13, the measurement value of which is fed to a control unit 15.

The lateral limit stops of the conveying channel consist of lateral transport belts 4 fed via rollers 5, 6, circulating at the same speed as the underframe belt, with one of the rollers 5, 6, being driven in each instance. The rollers 5 of the lateral transport belt 4 on the side of the locally fixed transfer roller 11 are similarly arranged in a locally fixed manner. The corresponding rollers 6 of the lateral transport belt 4 on the other side of the conveying channel 3 after the locally moveable transfer roller 12 are supported on roller levers 7 in a moveable and rotatable manner. The roller levers 7 can be rotated about a levering fulcrum 8 and are held in idle position with the narrowest channel width provided by means of pressure springs. The swivel motions are each achieved by an actuator with an eccentric tappet 9 engaging on the roller lever 7. A photo sensor 14 is also located before the conveying channel 3, said photo sensor being connected in a similar manner to the control unit 15. The photo sensor 14 detecting the front and back edges of the items of mail 1, 2 and the known transport speed allow the position and length of each item of mail 1, 2 to be determined at any time in the control unit and their thickness to be determined in the thickness sensor 13.

Correspondingly, input signals are transmitted to the connected actuator with the eccentric tappets 9. In this way, the eccentric tappets are adjusted and the roller levers 7 swiveled such that the rollers 6 move outwards with the transport belt 4 and each item of mail 1, 2 encounters a channel width during its transport through the conveying channel 3, which is somewhat wider than its widest thickness. This allows the items of mail 1, 2 to pass through the conveying channel 3 without jamming, and to orient themselves towards their lower narrow edge, but not to collapse. If the item of mail 2 following the leaving item of mail 1 at a relatively short distance has a different thickness, the roller 6 is correspondingly moved outwards at the conveying channel input, shortly before the leading edge of the item of mail has reached the conveying channel input. This can thus only occur once the trailing edge of the previously leaving item of mail 1 has left the input area. In this way, each locally moveable roller 6 is moved according to the thickness of the item of mail 1, 2, located in its area. This brings about a type of standing wave movement at this lateral limit stop which moves in conjunction with the items of mail 1, 2.

Figure 2:
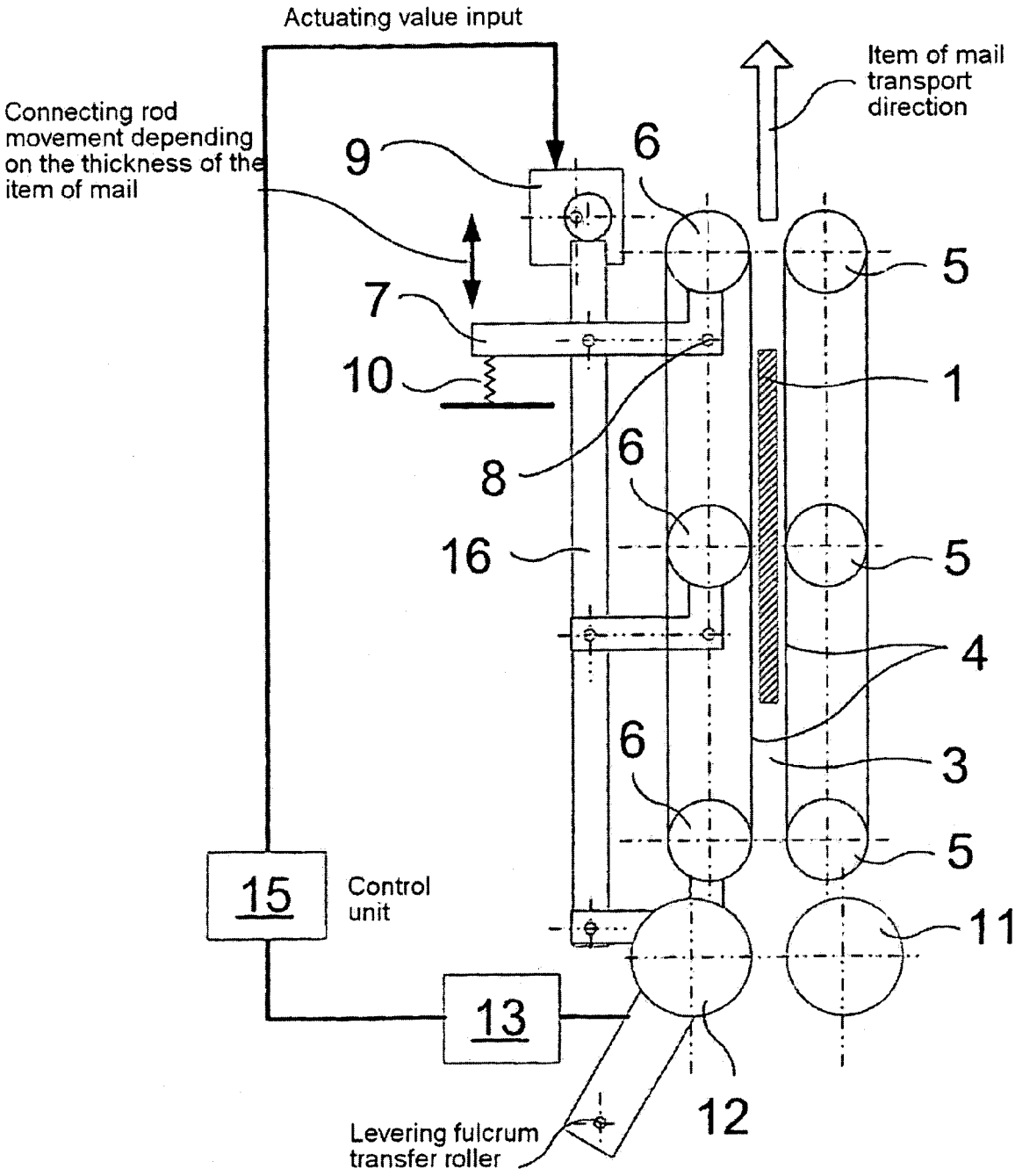
FIG. 2 shows a schematic overhead view on a generic device with lateral transport belts guided over rollers, with the position of the rollers being adjustable on one side in a common and uniform manner.

If the distances between the items of mail 1, 2 are so large, that only one item of mail 1, or 2 is ever conveyed or oriented in the conveying channel 3, it is not necessary to monitor the items of mail 1, 2, in the conveying channel 3. It is also enough then to adjust the rollers 6 in a collective and uniform manner. As shown in FIG. 2, it is thus enough if, with a measurement thickness change prior to entry into the conveying channel 3 in the control unit 15, an input signal is generated for only one actuator with a eccentric tappet 9, which displaces a connecting rod 16 such that roller levers 7 connected thereto are collectively rotated by a same amount. This swivel motion sets the conveying channel 3 at the measured thickness of the item of mail plus a predetermined value which guarantees a jam-free transport by preventing a flexible item of mail 1, 2, from collapsing. By virtue of the collective adjustment via the connecting rods 16, only one roller lever has to be reset into the idle state by means pressure springs which engage with it.

The lateral transport belt 4 can naturally also be adjusted by using other drives known to the person skilled in the art.

The invention claimed is:

1. A method for orienting flat items of mail towards a narrow edge using a U-shaped conveying channel with a driven underframe belt, in which the flat items of mail are conveyed one after the other via a determined path, in an upright position towards a narrow edge without being jammed, the method comprising the steps of:

measuring the thickness of the respective item of mail to be oriented, before the item of mail reaches the conveying channel, and changing the distance of lateral limit stops or limiting sections of the conveying channel corresponding to a respectively measured item of mail thickness, such that at the end of the conveying channel the respective item of mail is oriented towards the lower narrow edge by virtue of its own gravity and the distance of the lateral limit stops of the conveying channel from every item of mail during transport through the conveying channel is only wide enough for the item not to collapse at all nor to collapse partially even it its intrinsic stiffness is poor.

2. The method according to claim 1, wherein at least one of the lateral limit stops is designed to be flexible, and that from the known transport speed and a detected front and/or back edge, the length of the item of mail and the position of each item of mail during its transport through the conveying channel is determined as a function of the time and this data allows the lateral limit stops across the length of the conveying channel to be changed in terms of their distance from one another for each item of mail, such that lateral limiting sections of the flexible lateral limit stops adjusted to the respective thickness and length of the item of mail, like standing waves, move in conjunction with items of mail.

3. A device for orienting flat items of mail towards a narrow edge with a U-shaped conveying channel with a propelled underframe belt, in which the flat items of mail are conveyed one after the other over a determined path, in an upright position on a narrow edge without jamming, the device comprising:

a measuring device for determining the thickness of the respective item of mail to be oriented, before this has reached the conveying channel, and an adjusting mechanism engaging with at least one lateral limit stop for changing the distance between the lateral limit stop or between lateral limitation sections of the conveying channel corresponding to the respectively measured thickness of the item of mail, such that at the end of the conveying channel the item of mail is oriented towards the lower narrow edge by virtue of its own gravity and the distance of the lateral limit stops of the conveying channel from each item of mail during transport through the conveying channel is only wide enough for the item not to collapse at all nor to collapse partially even it its intrinsic stiffness is poor.

4. The device according to claim 3, wherein lateral transport belts circulating at the same speed as the underframe belt are provided as lateral limit stops of the conveying channel guided via rollers.

5. The device according to claim 4, wherein with distances between the items of mail with which only one item of mail is located in the conveying channel, the adjusting mechanism is designed such that all adjustable rollers are only collectively adjustable by the same amount.

6. The device according to claim 4, wherein the adjusting mechanism at each roller support engages with at least one transport belt and is controlled such that the lateral transport belts are changed as a function of the length of the item of mail and the position of each item of mail during its transport through the conveying channel, which in determined with the aid of the known transport speed and a detected leading edge and/or trailing edge, via the length of the conveying channel in their distance to one another for each item of mail, such that the transport belt sections adjusted to the respective thickness and length of the item of mail move in conjunction with the items of mail as standing waves.

* * * * *